United States Patent [19]

Lindo

[11] 4,211,415

[45] Jul. 8, 1980

[54] GOLF CLUB COMBINED WITH FOLDABLE EXTENSIONS FOR SURVEYING GREENS

[76] Inventor: Calvin E. Lindo, 4615 Hillside Rd., SE., Washington, D.C. 20019

[21] Appl. No.: 5,227

[22] Filed: Jan. 22, 1979

[51] Int. Cl.[2] ..... A63B 69/36

[52] U.S. Cl. ..... 273/162 B; 273/162 F

[58] Field of Search ..... 273/77 R, 80 R, 80 D, 273/81 R, 81 D, 81.4, 162 R, 162 B, 162 F, 183 D, 183 E, 186 R, 193 R, 194 R, 163 R, 163 A, 32 R, 32 H

[56] References Cited

U.S. PATENT DOCUMENTS

| | | | |
|---|---|---|---|
| 1,893,396 | 1/1933 | Bullough | 273/80 R |
| 2,321,773 | 6/1943 | Ruemelin | 273/81.3 X |
| 3,182,401 | 5/1965 | Stevens | 273/162 B X |
| 3,186,092 | 6/1965 | Bertas | 273/163 A X |
| 3,273,893 | 9/1966 | Duncan | 273/163 A |
| 3,535,792 | 10/1970 | Douglas | 273/32 H X |

*Primary Examiner*—Richard J. Apley

[57] ABSTRACT

A putter wherein the shaft between the grip and the head includes three folding guide ribs which can be pivoted to a position flush with the shaft or extending outwardly therefrom at right angles for the purpose of surveying a golf course green between the hole and the golf ball. Optionally, a level indicator can be included in one or more of the ribs. The ribs are secured relative to the shaft by a surrounding threaded ring in both the flush position and the outwardly extending position. In one embodiment, the ribs extend from only one side of the shaft, and in another embodiment, from both sides.

10 Claims, 4 Drawing Figures

GOLF CLUB COMBINED WITH FOLDABLE EXTENSIONS FOR SURVEYING GREENS

BACKGROUND OF THE INVENTION

It is a known technique in the game of golf for a golfer to survey the green between his ball and the hole to assist him in putting the golf ball into the hole. The majority of shafts on putters are straight and there is no provision thereon intended to assist the golfer in making this survey. Nevertheless, it is often observed that golfers, both professional and amateur, use their putter to plumb the distance between the ball and the hole, with some golfers standing and others bending from the waist or at the knees when using the putter in such a fashion. The present straight construction of the putting shaft addresses the problem of the straight line direction from the ball to the hole, but does not provide adequate means for estimating the pitch and slope of the terrain between the ball and the hole. An optical device for reading golf greens is disclosed in the patent to C. Bertas, U.S. Pat. No. 3,186,092. Basically, such patent discloses an apparatus which is fitted to the shaft of a putter for the purpose involved. In surveying the horizontal roll and pitch of a green it is considered advantageous for the golfer to view the green as being in small understandable square sections and then to study each such section having in mind how the ball must cross it accurately to travel to the hole.

The instant invention is directed to apparatus incorporated in a golf club which is intended to assist a golfer in making an accurate and proper survey of a green between the position of his golf ball and the hole.

SUMMARY OF THE INVENTION

The invention relates to a golf club in combination with a plurality of ribs which may be extended horizontally whereby the golfer is assisted in reading the slope, pitch and roll of the terrain of a green between where his golf ball is located and the hole in the green. Essentially, the invention is directed to a plurality of ribs which are pivotally connected to the shaft so that each rib may be selectively pivoted from a first position wherein it is aligned with the shaft to a second position wherein each rib extends within a single plane containing the shaft outwardly at a right angle relative to the longitudinal axis of the shaft. The ribs may optionally extend from both sides of the shaft or substantially from one side only. The shaft is provided with threads for each rib which receive interiorly threaded rings acting to secure the ribs in both their first and second positions. By using the ribs for guidance in defining sections of the green when they are laterally extended, the golfer's awareness of the pitch, roll and slope of the terrain is improved. It is, of course, to be understood that the length and thickness of the ribs is, within reasonable limits, optional depending upon the construction of the shaft and they may be composed of wood, plastic or metal as a matter of design choice. Preferably, however, they are of the same material as the shaft.

An important object of the invention is to provide a combined shaft structure for the golf club which serves the purpose described above and which also is sufficiently firm and strong that it may be used without detriment for its intended purpose of putting. In both positions, the ribs must thus be held firmly in place relative to the shaft of the golf club.

Other objects, adaptabilities and capabilities will be understood by those skilled in the art from the foregoing and as the description progresses, reference being had to the accompanying drawings, in which:

DESCRIPTION OF THE PREFERRED EMBODIMENTS

Figure 1:
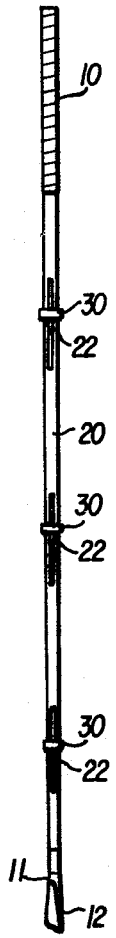
FIG. 1 illustrates a golf club in accordance with the invention wherein the ribs are flush in the club's shaft.
Figure 2:
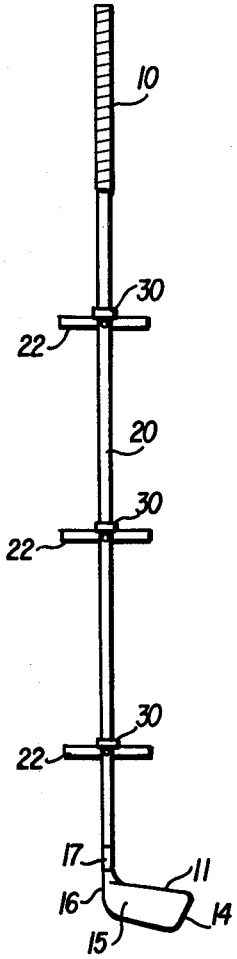
FIG. 2 is a side view of the club shown in FIG. 1 with, however, the ribs in their laterally extended position.
Figure 4:
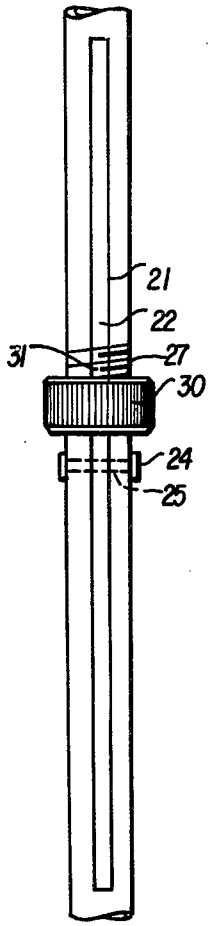
FIG. 4 is a further detailed view showing a rib flush with the shaft of the golf club.

In FIGS. 1 and 2, a golf club in accordance with the invention is illustrated which includes conventional parts such as the grip or handle 10, the head 11 which includes a face 12, a toe 14, a heel 15, a neck 16 and a hosel 17. The shaft 20 is connected to grip 10 and hosel 17 in a conventional manner as is well-known in the art. However, shaft 20 includes three aligned co-planar slots 21 which extend completely across the diameter of the shaft 20 and, as seen in FIGS. 1 and 4, each includes guidance rib 22. Each rib 22 is pivotally connected to shaft 20 by means of an axle comprising a rivet 24 which is received centrally in an opening or bore 25 in rib 22. It is to be understood that each axle 24 fits snugly into its corresponding bore 25 and, in the same connection, each rib 22 is received snugly within its corresponding slot 21. Preferably the ends 26 of each rib 22 are arcuate conforming to an arc which it has as its center at the center of bore 25. Also, preferably, each slot 21 has at its top and bottom a similar matching arcuate shape so that ends 26 are frictionally received thereby.

Shaft 20 is provided with three equally spaced-apart external threaded portions 27, each threaded portion 27 corresponding to the internal threads of a ring 30. In addition, each rib 22 has a threaded portion 31 which corresponds with and matches the external threads 27 whereby when each rib 22 is in a position as shown in FIGS. 1 and 4, the threads of the corresponding ring 30 are received not only by external threads 27 but also by threaded portion 31.

Figure 3:
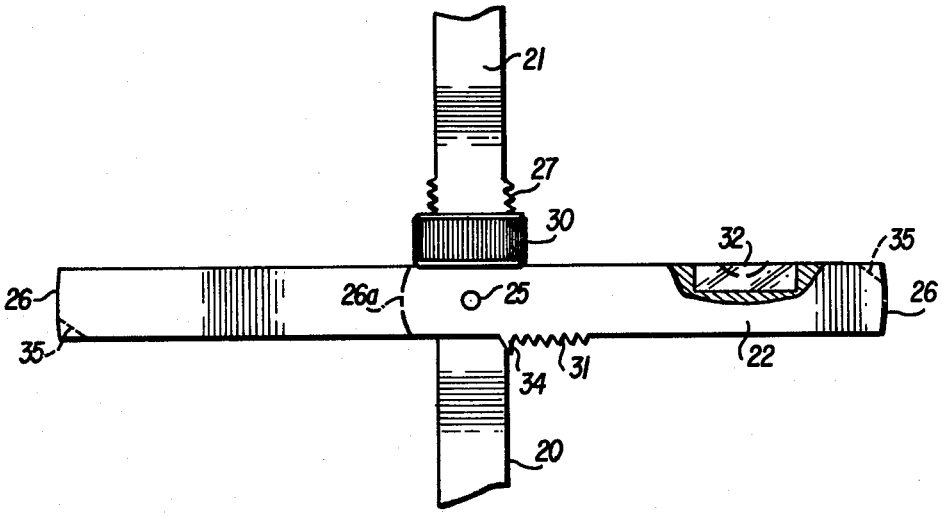
FIG. 3 is a detailed view in partial section showing one of the ribs in its laterally extended position.

Optionally, a portion of one or more of the ribs 22 may be removed and a level indicator 32 may be secured in the removed portion whereby rib 22 when in a position as shown in FIGS. 2 and 3, may be levelled by the golfer by means of a level indicator 32.

Also, optionally, one end 26 of the rib 22 may be terminated at **26*a* (shown by a dot-dash line) near shaft 20 whereby such rib extends outwardly in substantial distance only on one side of the shaft. In operation, the club is carried as shown in FIG. 1 whereby each threaded ring 30 surrounds both shaft 20 and the corresponding threaded portion 31 with the corresponding rib 22 aligned with shaft 20. When it is desired to utilize the putter, each ring 30 is loosened by turning same upwardly and each rib is rotated to the position shown in FIGS. 2 and 3 whereupon each threaded ring is moved downwardly and screwed tightly against the upper side of rib 22 whereby the putter then has each of its ribs 22 in an outwardly extending position as shown in FIGS. 2 and 3. Utilizing the club in this manner and using the level indicator 32, if included in one or more ribs 22, the golfer is now in a position to survey a green in relatively small understandable square segments whereby he can study each section of ground the ball must cross as it approaches the hole. The advantage for a golfer in using a putter as shown in the drawings is that greater accuracy is provided which comes with the improved depth perception made possible by using the adjustable ribs 22** for surveying the green.

If desired, a stop 34 may be included under or inboard relative to each threaded portion 31 so that each ring 30, when in position as shown in FIGS. 1 and 4, is blocked from being turned downwardly beyond the stop 34.

It will also be understood that each rib 22 has a width which is essentially the same as that of shaft 20 surrounding same. If the shaft 20 is tapered from top to bottom, then such tapering is also reflected in each rib 22. Such tapering is further taken into account for each threaded ring 30 whereby rings 30 are somewhat smaller in diameter from top to bottom.

If desired, a small edge denoted 35 in dot-dash lines in FIG. 3, may be removed from each rib 22 at its ends 26 and the corresponding slot 21 may be correspondingly shaped to include material at this point whereby each rib 22 can only be rotated from the position shown in FIG. 4 to the position shown in FIG. 3 in a clockwise direction as seen in the latter Figure.

Although the preferred embodiments of the invention have been described above, it is to be understood that the invention is capable of other adaptations and modifications within the scope of the appended claims. For example, the ribs may be collapsed flush with or into the shaft and may be activated automatically or manufally in a manner other than specifically shown. In addition, the ribs may be attached on both sides or only on one side of the shaft.

Having thus described my invention, what I claim as new and desire to secure by Letters Patent in the United States is:

1. A golf club which comprises a gripping handle, a shaft extending from said gripping handle, and a club head connected to said shaft opposite said gripping handle, said shaft having a plurality of ribs pivotably connected thereto whereby said ribs each may be pivoted selectively from a first position aligned with said shaft to a second position wherein they extend at a right angle relative to said shaft.

2. A golf club in accordance with claim 1 wherein said ribs are received firmly within said shaft when aligned therewith in said first position.

3. A golf club in accordance with claim 1 wherein securing means is provided on said shaft for selectively and firmly securing each of said ribs in both said first position and said second position.

4. A golf club in accordance with claim 3 wherein said securing means each comprise a ring which is threadably received on said shaft.

5. A golf club in accordance with claim 1 wherein said ribs when in said second position extend an equal lateral distance on opposite sides of said shaft.

6. A golf club in accordance with claim 1 wherein said ribs when in said second position extend outwardly a substantial distance only on one side of said shaft.

7. A golf club in accordance with claim 1 wherein an axle is received in said shaft for each said rib and each said rib is pivotable about its corresponding said axle.

8. A golf club in accordance with claim 1 wherein at least one of said ribs contains a horizontal level indicator.

9. A golf club which comprises a grip, a shaft means extending from said grip, and a club head connected to said shaft means opposite said grip, said shaft means being provided with a plurality of ribs which are connected thereto and are movable from a first position wherein said ribs are substantially aligned with said shaft means to a second position wherein said ribs extend at a right angle relative to said shaft means.

10. A golf club in accordance with claim 9 wherein said shaft means is connected to each of said ribs by pivot means extending through said ribs and said shaft means.

* * * * *